US005543685A

United States Patent [19]

Okamoto et al.

[11] Patent Number: 5,543,685

[45] Date of Patent: Aug. 6, 1996

[54] FLOURESCENT DISPLAY DEVICE HAVING A PROTECTIVE FILM INTERPOSED BETWEEN COLOR FILTERS AND ANODE ELECTRODES

[75] Inventors: Yoshinari Okamoto; Yoshihisa Tsuruoka; Haruhisa Hirakawa; Eiji Sato, all of Mobara, Japan

[73] Assignee: Futaba Denshi Kogyo K.K., Mobara, Japan

[21] Appl. No.: 273,937

[22] Filed: Jul. 12, 1994

[30] Foreign Application Priority Data

Jul. 12, 1993 [JP] Japan ..... 5-171710

[51] Int. Cl.[6] ..... H01J 29/18

[52] U.S. Cl. ..... 313/496; 313/466; 313/473; 313/474; 313/112; 359/893

[58] Field of Search ..... 313/466, 473, 313/474, 495, 496, 497, 489, 110, 112, 113; 427/68, 64; 359/891, 893

[56] References Cited

U.S. PATENT DOCUMENTS 2,543,477 2/1951 Sziklai et al. ..... 313/466

3,873,868 3/1975 Robinder ..... 313/466

4,717,856 1/1988 Kato ..... 313/473

*Primary Examiner*—Nimeshkumar D. Patel

*Attorney, Agent, or Firm*—Oblon, Spivak, McClelland, Maier & Neustadt, P.C.

[57] ABSTRACT

A fluorescent display device of the front emission type capable of permitting light-permeable anode conductors to be uniformly formed without any deformation and preventing color filters from being affected by etching carried out for forming the anode conductors. A light-permeable anode substrate is provided thereon with strip-like filters, which are then formed thereon with a uniform and flat protective film of light-permeable, insulating and etching-resistant properties. Then, anode conductors are arranged on the protective film. Thus, the anode conductors can be uniformly formed on the flat protective film irrespective of unevenness on a surface of the filters. Also, the protective film prevents the anode conductors from being exposed to etching liquid used for formation of the anode conductors.

1 Claim, 1 Drawing Sheet

FLOURESCENT DISPLAY DEVICE HAVING A PROTECTIVE FILM INTERPOSED BETWEEN COLOR FILTERS AND ANODE ELECTRODES

BACKGROUND OF THE INVENTION

This invention relates to a fluorescent display device, and more particularly to a fluorescent display device including filters.

There has been conventionally known a fluorescent display device which is adapted to carry out a full-color luminous display by means of color filters, which is generally constructed in such a manner as shown in FIG. 2. More particularly, a conventional fluorescent display device generally designated at reference numeral 100 in FIG. 2 includes an anode substrate 101 on which a display section is provided as described hereinafter.

The fluorescent display device 100 includes an air-tight envelope, of which a part is constituted by the anode substrate 101 made of a light-permeable insulating material. The anode substrate 101 is provided on an inner surface thereof with three kinds of strip-like color filters 102, 103 and 104 of red, green and blue colors R. G and B in turn in a repeated manner and so as to be contiguous to each other without defining any gap therebetween. The color filters 102 to 104 each are provided thereon with a strip-like light-permeable anode conductor 105. The anode conductors 105 each have strip-like phosphor layers 106 deposited thereon. Thus, the strip-like phosphor layers 106 cooperate with the strip-like anode conductors 105 to form a plurality of strip-like anodes 107 arranged in parallel to each other so as to be spaced from each other at predetermined intervals. A phosphor material of the same kind is commonly used for the phosphor layers. For example, a ZnO: Zn phosphor material having a luminous spectrum of a green luminous color may be conveniently used for the phosphor layers.

The fluorescent display device also includes control electrodes and electron emitting cathodes (not shown) each constructed in a predetermined structure and arranged above the strip-like anodes 107 arranged in a stripe-like matter, which cooperate with the anodes 107 to form a drive matrix. Matrix driving of the fluorescent display device 100 thus constructed permits the phosphors 106 of each of the anodes 107 selected to emit light of a green luminous color, which then passes through the color filters 102 to 104 and anode substrate 101, to thereby be provided with colors of the color filters separately.

In formation of the color filters described above, a color filter material is prepared for every desired color by mixing a frit glass powder with a pigment exhibiting each of desired colors. Subsequently, the color filter materials for the respective desired colors are applied to the anode substrate 101 by printing in turn and then dried, followed by calcination in a lump.

As will be noted from the above, the color filters each are formed by subjecting a color filter material mainly consisting of inorganic materials to calcination, so that considerable roughness or unevenness is formed on a surface of each of the color filters. Thus, it is highly difficult to form the color filters into a flat configuration on the anode substrate.

Unfortunately, this causes formation of the anode conductors at pitches as fine as, for example, 1 mm on the color filters thus formed to be highly difficult and troublesome. Also, it causes formation of each of the anode conductors in a manner to exhibit a uniform resistance to be extensively difficult. Use of an ITO film for the anode conductors causes them to be formed into an extensively reduced thickness, so that a resistance of each of the anode conductors is highly affected by or varied depending on unevenness on the surface of the color filters. Also, even use of an aluminum film for the anode conductors likewise causes a resistance of each of the anode conductors to be increased by unevenness of the color filters, resulting in the anode conductors being often broken.

Alternatively, the anode conductors each may be formed into a stripe-like configuration by etching. However, a chemical agent or etching liquid used for the etching often causes problems such as deterioration of the color filters, further formation of unevenness on the surface of the color filters, breaking of the anode conductors, and the like.

SUMMARY OF THE INVENTION

The present invention has been made in view of the foregoing disadvantage of the prior art.

Accordingly, it is an object of the present invention to provide a fluorescent display device of the type that luminescence of phosphor layers is observed through light-permeable anode conductors, color filters and a light-permeable anode substrate, which fluorescent display device is capable of permitting the anode conductors to be uniformly formed without any deformation.

It is another object of the present invention to provide a fluorescent display device of the type that luminescence of phosphor layers is observed through light-permeable anode conductors, color filters and a light-permeable anode substrate, which fluorescent display device is capable of preventing the color filters from being affected by etching for forming the anode conductors.

In accordance with the present invention, a fluorescent display device is provided. The fluorescent display device includes an envelope of which a part is constituted by an insulating light-permeable anode substrate, filters formed on an inner surface of the anode substrate, light-permeable anode conductors provided through the filters on the anode substrate, and phosphor layers formed on the anode conductors and adapted to emit light due to excitation, whereby light emitted from the phosphor layers is observed through the anode conductors, filters and anode substrate. The fluorescent display device generally constructed as described above is featured in that an insulating light-permeable protective film is arranged between the filters and the anode conductors.

In the fluorescent display device of the present invention constructed as described above, arrangement of the anode conductors on the filters is carried out through the protective film interposed therebetween, so that the anode conductors may be uniformly formed thereon. Also, when etching is carried out for formation of the anode conductors, the filters may be effectively prevented from being affected by etching liquid used for the etching, because they are covered with the protective film.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a fluorescent display device of the present invention will be described hereinafter with reference to FIG. 1.

Figure 1:
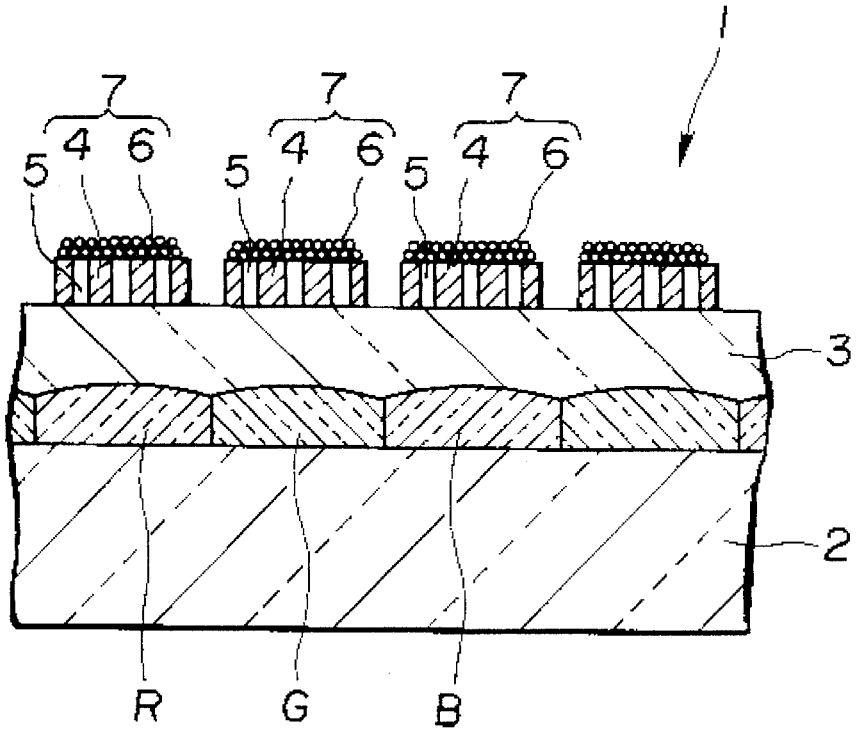
FIG. 1 is a fragmentary enlarged sectional view showing an essential part of an embodiment of a fluorescent display device according to the present invention.
Figure 2:
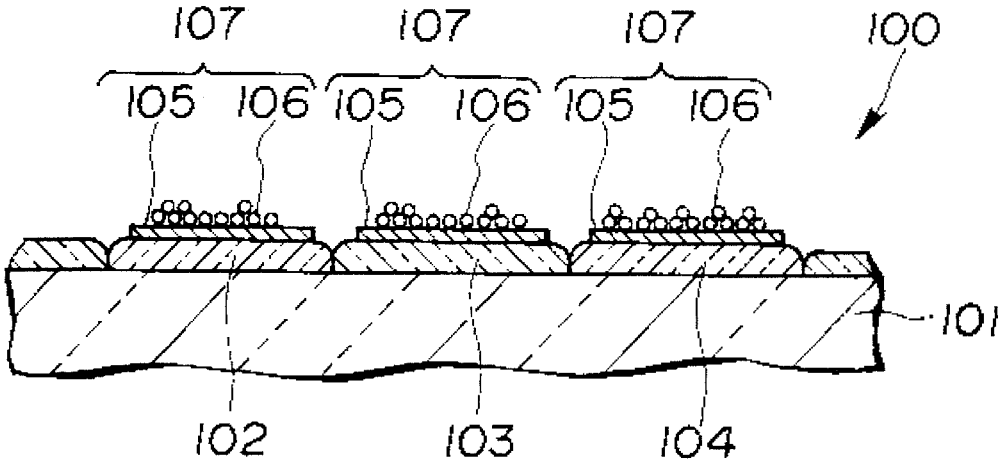
FIG.2 PRIOR ART
FIG. 2 is a fragmentary enlarged sectional view showing an essential part of a conventional display device including color filters constructed in a conventional manner.

FIG. 1 shows an embodiment of a fluorescent display device according to the present invention, which is constructed so as to carry out a full-color graphic display.

A fluorescent display device of the illustrated embodiment which is generally designated at reference numeral 1 in FIG. 1 includes a box-like envelope formed by sealedly integrally joining an anode substrate 2 made of an insulating light-permeable material and a cathode substrate (not shown) made of an insulating material to each other through insulating spacer members (not shown). The envelope thus formed is then evacuated to a high vacuum.

The anode substrate 2, as shown in FIG. 1, is formed on an inner surface thereof with, for example, strip-like red, green and blue color filters R, G and B in turn in a repeated manner.

For the purpose of forming each of the color filters R, G and B, a paste-like color filter material is prepared by mixing an inorganic filter material mainly consisting of a composite-oxide pigment with a vehicle serving as a viscous material. Then, the color filter material is depositedly applied in a strip-like configuration to the anode substrate 2 by any suitable techniques such as photolithography, printing or the like. Such deposition of the color filter material is repeatedly carried out for every color, followed by drying. The color filter materials for all colors thus deposited are finally calcined in a lump.

The color filters each may include in addition to the above-described inorganic filter material, colored glass, metal colloid (lustering), a metal ion substituent (staining) and the like.

The color filters R, G and B are covered with a protective layer or film 3 provided thereon. The protective film 3 is formed into a suitable thickness between thousands Å and several μm. Also, the protective film 3 is formed so as to have a smooth and flat surface irrespective of unevenness on a surface of the color filters R, G and B and be substantially free of any cracking or other defects.

The protective film 3 exhibiting such uniformity as described above is preferably formed of an amorphous inorganic material which exhibits satisfactory heat resistance at a temperature up to about 600° C. Formation of the protective film 3 may be carried out by subjecting an amorphous material such as $SiO_2$, MgO or the like to electron beam deposition.

Alternatively, formation of the protective layer may take place using, for example, $Al_2O_3$ as the amorphous inorganic material. More particularly, a stock solution of alumina sol is mixed with ethanol and pure water, resulting in being diluted, to thereby prepare an alumina sol solution of 1 to 10 wt % in concentration. The solution is depositedly applied in a thickness of about 0.3 to 3 μm on the color filters by any suitable means such as screen printing, spin coating, roll coating or the like, leading to formation of a raw film. Then, the raw film thus formed is subject to calcination at a temperature of 500° to 600° C., to thereby complete the protective film 3.

Also, $TiO_2$ may be used as the amorphous inorganic material. The amorphous inorganic materials exemplified above may be used solely or in combination.

The fluorescent display device of the illustrated embodiment further includes a plurality of light-permeable anode conductors 4 formed into a strip-like shape and provided on the protective film 3. The strip-like anode conductors 4 are arranged at predetermined intervals in a stripe-like manner and so as to positionally correspond to the color filters R, G and B, respectively. In the illustrated embodiment, the anode conductors 4 each are formed of an aluminum film which may be prepared by etching carried out through a mask formed by photolithography, resulting in being formed with openings 5 in a predetermined fine pattern. Alternatively, the anode conductors 4 each may be formed of an ITO film.

The anode conductors 4 each are formed thereon with a plurality of strip-like phosphor layers 6, so that the strip-like phosphor layers 6 cooperate with the strip-like anode conductors 4 to constitute a plurality of strip-like anodes 7 arranged in parallel with each other at predetermined intervals. Thus, the strip-like anodes 7 are arranged in a stripe-like manner. The phosphor layers 6 are commonly formed of a phosphor material of the same kind. For example, they may be commonly formed of a ZnO: Zn phosphor material having a wide luminous spectrum about green.

The phosphor layers 6 may be formed using any suitable conventional means such as photolithography, printing, electro-deposition or the like.

Above the anodes 7 arranged in a stripe-like manner are arranged control electrodes and electron emitting cathodes (not shown), which are constructed in a predetermined structure so as to cooperate with the anodes 7 to form a drive matrix.

When the fluorescent display device 1 constructed as described above is subject to matrix driving, electrons emitted from the cathodes are permitted to impinge on the phosphors 6 of each of the strip-like anodes 7 selected, resulting in an anode current flowing through the corresponding anode conductors 4, so that light of a green luminous color emitted from the phosphors 6 due to excitation or impingement of electrons thereon travels through the light-permeable anode conductors 4, light-permeable protective film 3, color filters R, G and B and light-permeable anode substrate 2 to an exterior of the envelope. Thus, the light may be observed in colors of the color filters R, G and B, respectively.

As described above, the anode conductors 4 are arranged on the protective film 3 uniformly formed on the color filters R, G and B, resulting in being uniformly accurately formed into predetermined fine dimensions irrespective of unevenness on the surface of the color filters. Thus, the anode conductors 4 each may be formed so as to exhibit substantially the same resistance as designed.

Also, in the illustrated embodiment, the anode conductors 4 may be formed by etching. Nevertheless, the color filters R, G and B are effectively prevented from being adversely affected by etching liquid used for the etching because of being protected by the protective film 3.

Further, the color filters R, G and B are hard to be damaged because of being protected by the protective film 3, to thereby be significantly prevented from being affected by heat during a heating step in manufacturing of the fluorescent display device 1.

In the embodiment described above, the protective film 3 is formed of an amorphous inorganic material, however, formation of the film 3 in the present invention is not limited to use of the amorphous inorganic material. The protective film 3 may be made of any other suitable material so long as it provides the protective film with light-permeability and insulating properties and exhibits a function of protecting the color filters.

As can be seen from the foregoing, the fluorescent display device of the present invention is so constructed that the light-permeable anode conductors are arranged through the protective film on the color filters provided on the anode conductor. Such construction permits the protective film to be uniformly formed on the color filters irrespective of unevenness on a surface of the color filters, so that the anode conductors formed on the protective film may have a surface uniformly or smoothly formed. Thus, the anode conductors may exhibit substantially the same resistance as designed.

Also, even when the anode conductors are formed by etching, the color filters are effectively prevented from being affected by an etching liquid used for the etching because of being effectively protected by the protective film.

Further, the color filters are hard to be damaged because of being protected by the protective film, to thereby be significantly prevented from being adversely affected or discolored by heat during a heating step in manufacturing of the fluorescent display device.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

an envelope of which a part is constituted by an insulating light-permeable anode substrate;

filters formed on an inner surface of said anode substrate;

an insulating light-permeable protective film arranged on said filters;

light-permeable anode conductors provided on said protective film; and phosphor layers formed on said anode conductors and adapted to emit light due to excitation, which light is observed through said anode conductors, protective film, filters and anode substrate.

* * * * *